US007575189B2

(12) United States Patent
Shirazi

(10) Patent No.: US 7,575,189 B2
(45) Date of Patent: Aug. 18, 2009

(54) HOLDERS FOR LINEAR MATERIAL

(76) Inventor: Kamran Shirazi, 3726 Broderick St. #2, San Francisco, CA (US) 94123

( * ) Notice: Subject to any disclaimer, the term of this patent is extended or adjusted under 35 U.S.C. 154(b) by 381 days.

(21) Appl. No.: 11/097,581

(22) Filed: Apr. 1, 2005

(65) Prior Publication Data

US 2006/0219589 A1 Oct. 5, 2006

(51) Int. Cl.
*B65H 75/18* (2006.01)

(52) U.S. Cl. ..... 242/610.2; 242/588

(58) Field of Classification Search ..... 242/588, 242/588.3, 588.4, 604, 610, 610.1, 610.2, 242/476.6, 118.1, 125, 125.1, 125.2, 125.3; 206/395, 396, 397, 389; 229/115, 116
See application file for complete search history.

(56) References Cited

U.S. PATENT DOCUMENTS

| | | | | |
|---|---|---|---|---|
| 1,052,303 | A | 2/1913 | Aven | |
| 1,205,906 | A | 11/1916 | Kuehn | |
| 1,372,884 | A * | 3/1921 | King | 206/389 |
| 1,762,386 | A | 6/1930 | Collingbourne | |
| 1,871,388 | A | 8/1932 | Pflueger | |
| 2,425,155 | A * | 8/1947 | Jarvis | 242/610.2 |
| 2,477,333 | A | 7/1949 | Hawkins | |
| 3,357,550 | A * | 12/1967 | Holmes et al. | 206/63.3 |
| 3,537,667 | A | 11/1970 | Dorman | |
| 3,643,795 | A | 2/1972 | Watwood et al. | |
| 3,838,602 | A | 10/1974 | Hanson et al. | |
| 3,931,887 | A | 1/1976 | Beck | |
| 4,239,110 | A * | 12/1980 | Enke et al. | 206/396 |
| 4,244,538 | A | 1/1981 | Theros | |
| 5,287,965 | A | 2/1994 | Miller | |
| 5,513,819 | A * | 5/1996 | Orange | 242/610.2 |
| 5,735,483 | A | 4/1998 | Bierlein | |
| 2005/0126945 | A1 * | 6/2005 | Selby | 206/395 |

* cited by examiner

*Primary Examiner*—John Q. Nguyen
*Assistant Examiner*—William E Dondero
(74) *Attorney, Agent, or Firm*—Kolisch Hartwell, PC

(57) ABSTRACT

A holder for wire material is disclosed. The holder includes a unitary body having interconnected and substantially planar expanses each having a discrete opening configured to receive and support a portion of the wire material as the wire material is wrapped around the interconnected and substantially planar expanses.

17 Claims, 2 Drawing Sheets

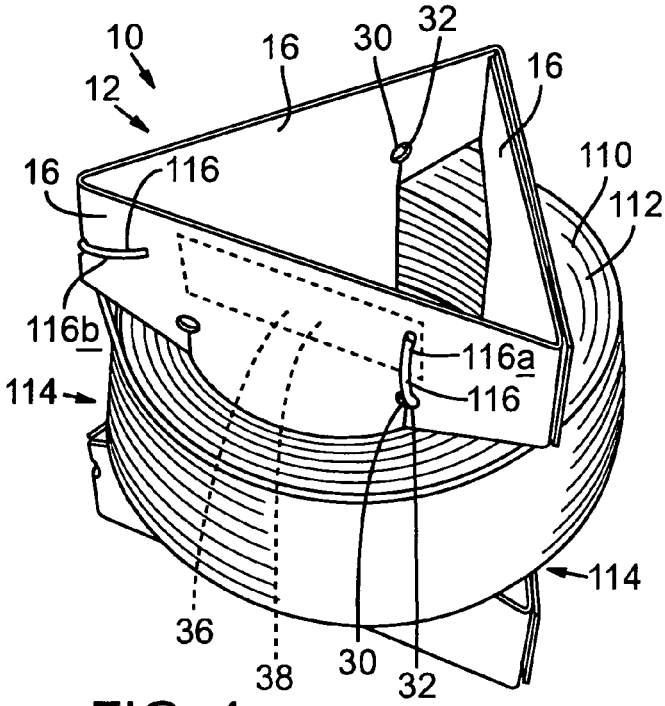
FIG. 1
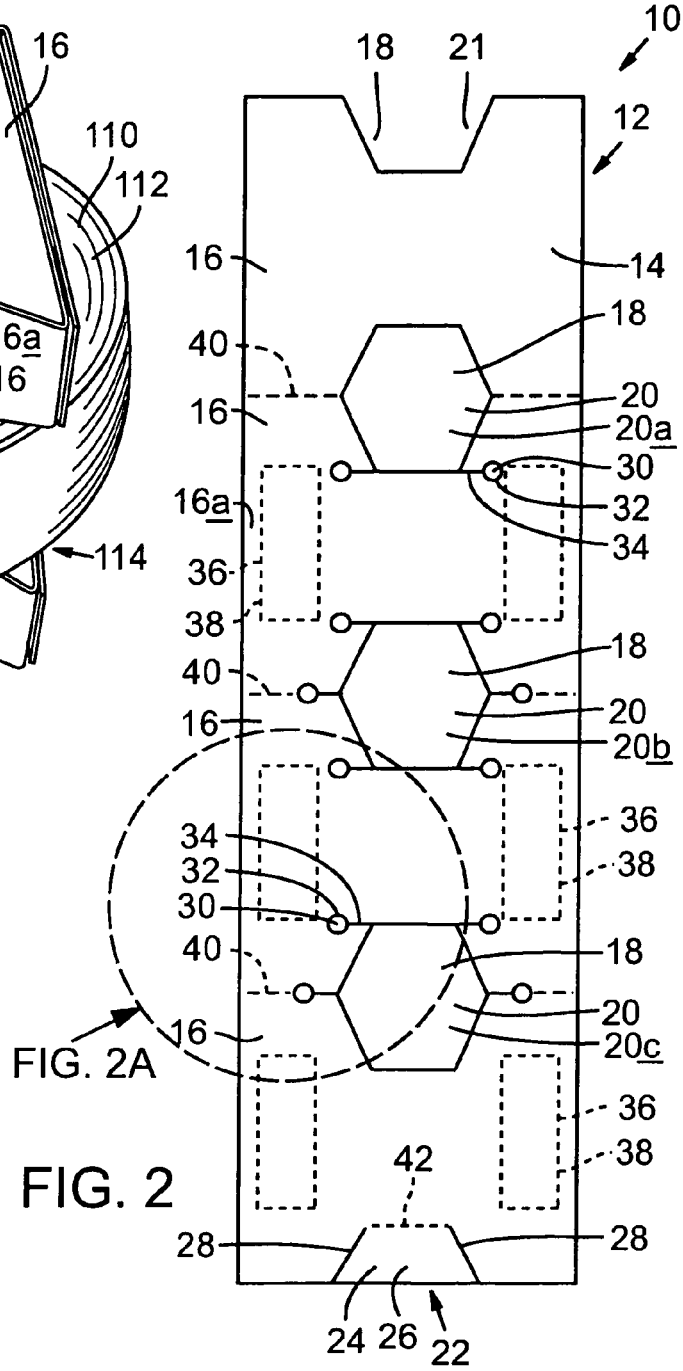
FIG. 2
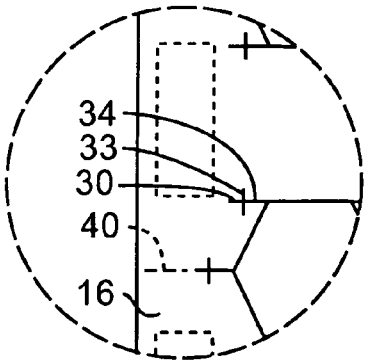
FIG. 2A
FIG. 2A

HOLDERS FOR LINEAR MATERIAL

TECHNICAL FIELD

The invention generally relates to holders for linear material, and more particularly to holders for wire material.

BACKGROUND

Linear material, such as cables and wires, increasingly are being used for a variety of applications. Those applications may include connecting appliances to other appliances, to power outlets, to antenna outlets, to phone outlets, etc. The linear material may, however, be difficult to store in a compact and/or convenient manner. The storage problems may be more pronounced when considerable lengths of the linear material are involved, such as in hardware stores, consumers' garages, etc. Additionally, people may wish to store the excess length of linear material being used, such as the excess length of an electric cord for an appliance.

The use of holders may facilitate storage of the linear material, particularly for linear material of considerable length. The linear material may be wrapped, coiled, and/or wound around the holder for storage. Examples of holders are provided for in U.S. Pat. Nos. 1,052,303; 1,205,906; 1,762,386; 1,871,388; 2,477,333; 3,537,667; 3,643,795; 3,838,602; 3,931,887; 4,244,538; 5,287,965; 5,513,819; and 5,735,483, the entire disclosures of which are herein incorporated by reference for all purposes.

SUMMARY

One embodiment provides a holder for wire material. The holder includes a unitary body having interconnected and substantially planar expanses each having a discrete opening configured to receive and support a portion of the wire material as the wire material is wrapped around the interconnected and substantially planar expanses.

BRIEF DESCRIPTION OF THE DRAWINGS

FIG. 1 is an isometric view of the holder with linear material wrapped around the holder.

FIG. 2 is a top view of the holder of FIG. 1, illustrating the holder before it is assembled.

FIG. 2A is a partial view of the holder of FIG. 2, illustrating alternative receiving portions for the linear material.

DETAILED DESCRIPTION

Figure 3:
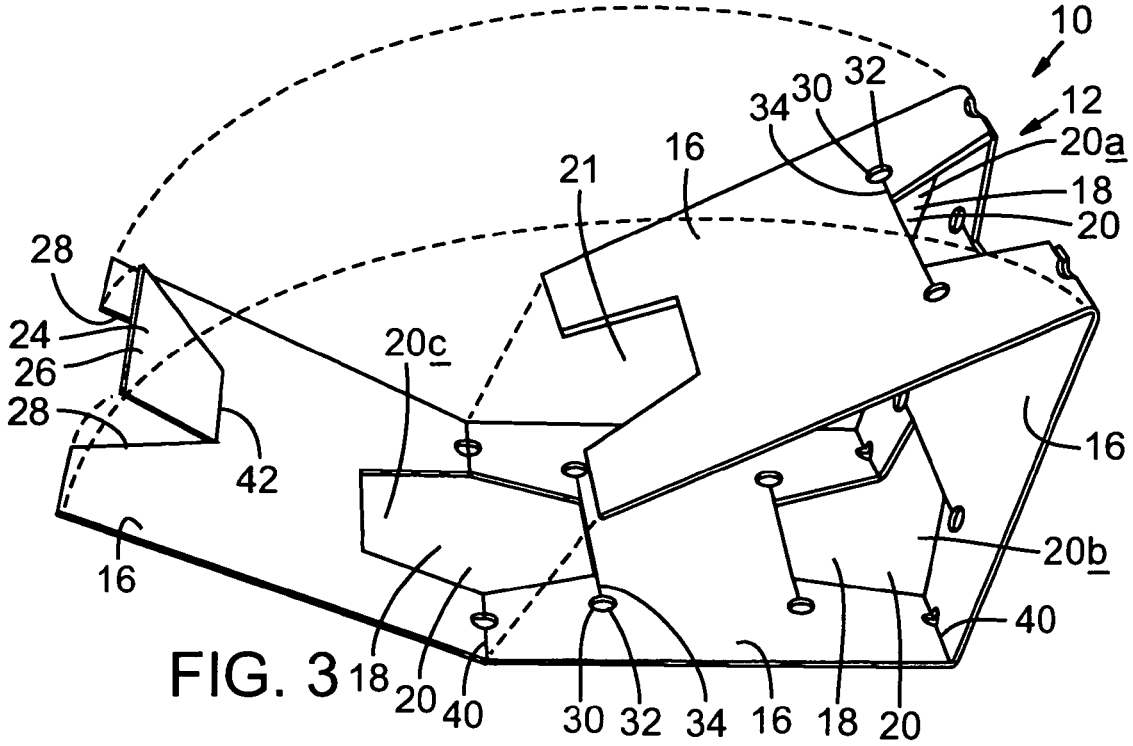
FIG. 3 is an isometric view of the holder of FIG. 1, illustrating the holder as it is being assembled.

Referring to FIG. 1, a holder 10 is shown with linear material 110 wrapped around the holder. Linear material 110 may include any elongate material with characteristics that allow the linear material to be wrapped, coiled, and/or wound around a structure. For example, linear material may include wire material 112. Other examples of linear material include cable, thread, yarn, fabric, rope, power cord, Christmas lights, etc.

Holder 10 may include any suitable structure configured to store the linear material. For example, as shown in FIGS. 1-4, holder 10 may include a body 12. Body 12 may be made of any suitable material, including cardboard, paper, metal, etc. The body also may be any suitable shape configured to store the linear material. For example, body 12 may have a triangular prism shape (with a triangular cross-section), as shown in FIGS. 1 and 4. Although body 12 is shown to have the shape of a triangular prism, the body may have any suitable shape configured to store the linear material, such as cubes, cylinders, tetrahedrons, octahedron, quadrilateral prisms, pentagonal prisms, etc.

Additionally, body 12 may be unitary or may be formed from two or more components. For example, body 12 may be unitary and/or formed from an elongated and substantially flat piece of material 14, as shown in FIG. 2. Although holder 10 is shown to be formed from an elongated and substantially flat piece of material, the holder may be formed from any suitable piece or pieces of material, including circular material and/or material with appreciable thickness.

Body 12 may include expanses 16, which may be any suitable shape and/or structure configured to form body 12. For example, expanses 16 may be interconnected and/or substantially planar, as shown in FIG. 2. Although body 12 is shown to include interconnected and substantially planar expanses, any suitable expanses may be used.

The expanses may include openings 18, which include any suitable shape and/or structure configured to support portions 114 of linear material 110 as the material is wrapped around the expanses. Additionally, openings 18 may be discrete or continuous. For example, openings 18 may be in the form of discrete hexagonal cutouts 20 and a trapezoidal cutout 21. Although openings 18 are shown to be hexagonal and trapezoidal shaped, the openings may be any suitable shape, such as square-shaped, rectangular shaped, circular-shaped, etc.

The openings may be in any suitable location and/or arrangement on body 12. Each of expanses 16 may have one or more openings 18 located in any suitable location. Additionally, or alternatively, each of expanses 16 may include halves of two of the openings. For example, a first expanse 16*a* may include one-half of a first hexagonal cutout 20*a* and one-half of a second hexagonal cutout 20*b* on opposite ends of the expanse. The other expanses may include similarly arranged hexagonal cutouts, as shown in FIGS. 1-4.

Body 12 also may include a locking mechanism 22, which may include any shape and/or structure configured to maintain the body in its desired shape, particularly when linear material 110 is being wrapped around the body. For example, locking mechanism 22 may include a protruding portion 24 and at least one of openings 18.

Protruding portion 24 may include any suitable shape and/or structure configured to engage at least one of openings 18 and lock body 12 in its desired shape. For example, protruding portion 24 may be in the form of a tab 26. Tab 26 may be cutout from body 12, such as by adjacent slits 28 on body 12. Alternatively, tab 26 may be attached to body 12. Although protruding portion is shown to be trapezoid in shape, any suitable shape may be used configured to engage at least one of openings 18 and lock body 12 in its desired shape.

Additionally, body 12 may include one or more receiving portions 30, which may include any suitable shape and/or structure configured to receive at least one end 116 of linear material 110 and/or to secure that end to the body. For example, the receiving portions may include one or more apertures 32, as shown in FIGS. 1-4. Although the apertures are shown to have the shape of circles, any suitable shape may be used configured to receive at least one end 116 of linear material 110 and/or secure that end to the body, such as triangles, squares, rectangles, etc.

Alternatively, or additionally, receiving portions may include cross slits 33, as shown in FIG. 2A. Although the cross slits are shown to be in the form of "+", any suitable arrangement of the cross-slits may be used configured to receive at least one end 116 of linear material 110 and/or secure that end to the body, including cross slits in the form of "x" or the like. Moreover, although FIG. 2A shows only three of receiving portions 30 to be in the form of cross slits 33, any suitable number of the receiving portions may be in the form of cross slits 33, including all of the receiving portions.

The apertures may be located and/or arranged in any suitable manner on body 12. For example, as shown in FIG. 2, two of apertures 32 may be located adjacent to first hexagonal cutout 20*a*, six may be located adjacent to second hexagonal cutout 20*b*, and/or four may be located adjacent to a third hexagonal cutout 20*c*. Although the apertures are shown to be arranged and/or located in a particular manner, any suitable arrangement and/or location may be used. Receiving portions 30 also may include slits 34, which may include any suitable shape and/or structure configured to provide access to apertures 32.

Moreover, body 12 may include one or more display portions 36, which may include any suitable shape and/or structure configured to allow the user to provide information regarding the linear material or on any suitable subject matter. The information may include price, length, part number, etc. The display portions may be in the form of one or more labels 38, which may include the information in text, barcode, or any suitable form.

Body 12 and its components discussed above may have any suitable dimensions. For example, body 12 may be formed from substantially flat piece of material 14 that has a length of 28½ inches and a width of 6 inches. Locking mechanism 22 also may have slits 28 that are each 1-2 inches long. Openings 18 may have hexagonal cutouts 20 with sides that are 2 inches long. Although certain dimensions have been disclosed, body 12 and/or one or more of its components may have any suitable dimensions.

Figure 4:
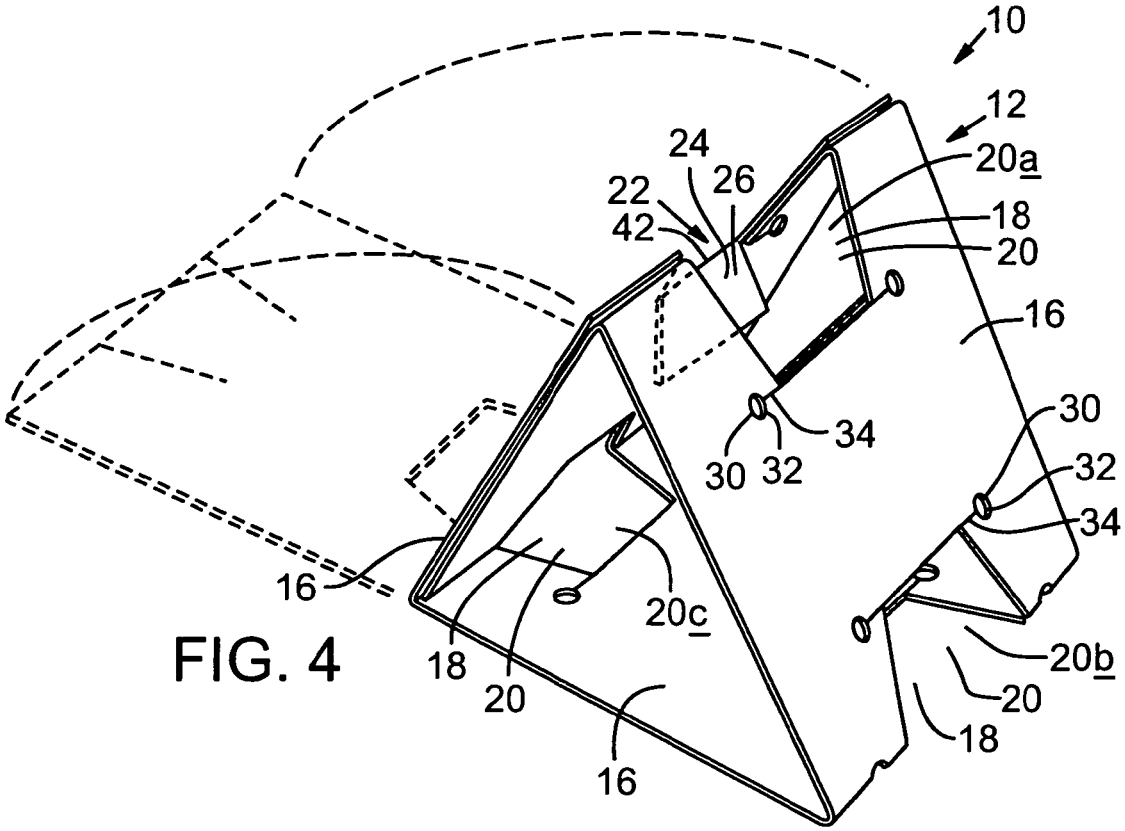
FIG. 4 is an isometric view of the holder of FIG. 1, illustrating the holder fully assembled.

FIGS. 1-4 illustrate an embodiment of a method for holding linear material in accordance with the present disclosure for holder 10. An elongated and substantially flat piece of material may be cut, stamped, or otherwise modified to resemble material 14 in FIG. 2. Material 14 may then be folded at folding lines 40, as shown in FIG. 3. Protruding portion 24 may then folded at folding line 42 and may be inserted into one of openings 18.

A first end 116*a* of linear material 110 may be inserted into one of apertures 32 by inserting the first end into an adjacent slit 34 and moving the first end to the aperture. The linear material may then be wrapped, coiled, and/or wound around expanses 16 such that each of the openings receives a portion of the linear material. A second end 116*b* may then be inserted into one of apertures 32 by inserting the second end into an adjacent slit 34 and moving the second end into the aperture. One or more labels 38 may be used to provide information regarding the linear material and/or any other suitable information. The steps discussed above may, however, be performed in different sequences and in different combinations, not all steps being required for all embodiments of the holder.

Although holders and features of holders have been shown and described with reference to the foregoing operational principles and preferred embodiments, those skilled in the art will find apparent that various changes in form and detail may be made without departing from the, spirit and scope of the claims. The present disclosure is intended to embrace all such alternatives, modifications, and variances that fall within the scope of the appended claims.

I claim:

1. A holder for wire material, comprising:

a unitary body having interconnected and substantially planar expanses each having a discrete polygon opening configured to receive and support a portion of the wire material within the opening as the wire material is wrapped around the interconnected and substantially planar expanses, each planar expanse further having a linear folding line extending across two vertices of the polygon opening so that no angle between two edges of the opening on either side of the line is less than 90 degrees;

wherein the unitary body includes a protruding portion configured to engage at least one of the discrete openings and be folded into an interior of a cross section of the body so that when the wire material is wrapped around the interconnected and substantially planar expanses, the wire material reinforces the engagement of the protruding portion with the discrete opening.

2. The holder of claim 1, wherein the unitary body is formed from an elongated and substantially flat piece of material.

3. The holder of claim 1, wherein the unitary body includes one or more receiving portions configured to secure at least one end of the wire material to the unitary body.

4. The holder of claim 3, wherein the one or more receiving portions include one or more apertures.

5. The holder of claim 3, wherein the one or more receiving portions include one or more cross slits.

6. The holder of claim 3, wherein the one or more receiving portions are located adjacent at least one of the discrete openings.

7. A holder for wire material, comprising:

a unitary body formed from an elongated and substantially flat piece of material, wherein the unitary body includes interconnected and substantially planar expanses each having a discrete polygon opening configured to receive and support a portion of the wire material within the opening as the wire material is wrapped around the planar expanses, each planar expanse further having a linear folding line extending across two vertices of the polygon opening so that no angle between two edges of the opening on either side of the line is less than 90 degrees;

wherein the unitary body includes a tab formed from two adjacent slits on a side of the unitary body, wherein the tab is configured to engage one of the discrete openings and be folded into an interior of a cross section of the body so that when the wire material is wrapped around the interconnected and substantially planar expanses, the wire material reinforces the engagement of the tab with the discrete opening.

8. The holder of claim 7, wherein the unitary body includes a triangular cross-section.

9. The holder of claim 7, wherein the unitary body includes at least three edges.

10. The holder of claim 7, wherein at least one of the discrete openings are hexagonal in shape.

11. The holder of claim 7, wherein the unitary body includes one or more receiving portions configured to secure at least one end of the wire material.

12. The holder of claim 11, wherein the unitary body includes at least one slit configured to provide access to the one or more receiving portions.

13. A method for holding wire material, comprising:

folding an elongate and substantially flat piece of material into a holder, wherein the holder includes interconnected and substantially planar expanses each having a discrete polygon opening configured to receive and support a portion of the wire material within the opening, and wherein folding includes folding each planar expanse along a linear folding line that extends across two vertices of the polygon opening so that no angle between two edges of the opening on either side of the line is less than 90 degrees; and wrapping the wire material around the interconnected and substantially planar expanses such that each of the discrete polygon openings receives a portion of the wire material;

wherein the elongate and substantially flat piece of material includes a protruding portion, and wherein folding an elongate and substantially flat piece of material into a holder includes inserting the protruding portion into one of the discrete openings and into an interior of a cross section of the holder so that when the wire material is wrapped around the interconnected and substantially planar expanses, the wire material reinforces the insertion of the protruding portion into the discrete opening.

14. The method of claim 13, wherein the holder includes at least one receiving portion, further comprising inserting a first end of the wire material into the at least one receiving portion.

15. The method of claim 14, wherein the holder includes at least one slit configured to provide access to the at least one receiving portion, wherein inserting a first end of the wire material into the at least one receiving portion includes inserting the first end of the wire material into the at least one slit, and sliding the first end of the wire material into the at least one receiving portion.

16. The method of claim 14, further comprising inserting a second end of the wire material into the at least one receiving portion.

17. The method of claim 16, wherein the holder includes at least one slit, wherein inserting a second end of the wire material into the at least one receiving portion includes inserting the second end of the wire material into the at least one slit, and sliding the second end of the wire material into the at least one receiving portion.

* * * * *

UNITED STATES PATENT AND TRADEMARK OFFICE

CERTIFICATE OF CORRECTION

PATENT NO. : 7,575,189 B2
APPLICATION NO. : 11/097581
DATED : August 18, 2009
INVENTOR(S) : Kamran Shirazi It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 775 days.

Signed and Sealed this

Seventh Day of September, 2010

David J. Kappos

David J. Kappos
*Director of the United States Patent and Trademark Office*